US006279365B1

(12) United States Patent
Tseng

(10) Patent No.: US 6,279,365 B1
(45) **Date of Patent: *Aug. 28, 2001**

(54) COLD FORGING FORMING METHOD FOR THREE-DIMENSIONAL HOLLOW ARTICLE

(76) Inventor: Shao-Chien Tseng, No. 130, Sec. 2, Yang-Shin Rd., Yang-Mei, Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/592,093

(22) Filed: Jun. 12, 2000

(51) Int. Cl.[7] ..... B21D 39/08
(52) U.S. Cl. ..... 72/58; 72/62; 29/421.1
(58) Field of Search ..... 72/58, 60, 61; 29/421.1

(56) References Cited

U.S. PATENT DOCUMENTS 2,168,641 * 8/1939 Arbogast ..... 72/58
3,383,901 * 5/1968 Stalter ..... 72/58
5,813,266 * 9/1998 Ash ..... 72/58
5,884,516 * 3/1999 Tseng ..... 72/58

* cited by examiner

*Primary Examiner*—David Jones
(74) *Attorney, Agent, or Firm*—Pro-Techtor International Services

(57) ABSTRACT

A cold forging forming method for forming a three-dimensional hollow article without rough edges, wherein, an alloy of low melting point is used instead of mercury as a filler with plasticity. When the alloy of low melting point is heated and molten, it can be poured, discharged and recollected at normal temperatures but can have good stiffness after being solidified, thereby, the solidified alloy of low melting point can support a seamless die cavity against forging pressure, thereby, a stiff wall of the seamless die cavity is formed. A shaped work piece in the die cavity can be released when the solidified alloy is heated to melt, and an inner die for a different die cavity can be substituted for the old one, and an effect of recovery for reusing the filler can be achieved, and cost of forming can be reduced. All these meet the requirement of environment protection.

1 Claim, 7 Drawing Sheets

COLD FORGING FORMING METHOD FOR THREE-DIMENSIONAL HOLLOW ARTICLE

BACKGROUND OF THE INVENTION

1. Field of the Invention

The present invention is related to a cold forging forming method for forming a three-dimensional hollow article without rough edges, and especially to a cold forging forming method using an alloy of low melting point instead of mercury as a filler with plasticity, for saving expensive chilling equipment and providing another effect of easy management of operation; thereby cost of purchasing as well as forming can be effectively reduced, besides, latent public damage of pollution in the processing of forming can be eliminated, and safety of forming can thus be increased.

2. Description of the Prior Art

The inventor of the present invention has obtained a U.S. Pat. No. 5,884,516 "THREE DIMENSIONAL COLD FORGING METHOD FOR SHAPING A HOLLOW ARTICLE AND THE APPARATUS FOR THE METHOD". Wherein, liquid mercury is used as a freezing medium filled in the space between a die protecting member and the external wall of a seamless die cavity. The liquid mercury can be poured, discharged and recollected at normal temperatures but can have good stiffness after being frozen, thereby, the freezing medium can support the die cavity against forging pressure after being frozen. By the law of conservation of energy, and by the high plasticity of polyurethane, a polyurethane strip placed in a blank to be forged swages the blank when it is pressed to deform and expand by a forging press. In this way, the inner and external walls of the blank is shaped into the shape of a three dimensional seamless die cavity, thus troubles in producing three dimensional artistic articles can be solved.

However, cost of equipment for fast freezing in the markets is much higher than that of heating equipment. And freezing temperature of liquid mercury is −38.5° C., thereby, liquid mercury is preferably to be fast frozen to −40° C. in favor of shaping the cold forged blank, this induces increasing of cost in purchasing equipment. And energy consumption for freezing liquid mercury is much larger than that for the equipment for heating, thereby cost of production can be higher and tends to be a burden. And more, liquid mercury has high specific gravity and is a kind of expensive metal; it is fluid at normal temperatures. When in delivery, it is extremely subjected to generating spattering; this makes inconvenience in management by operators, and tends to create damage to human bodies and public pollution environmentally. Therefore, this forms a very large trouble in the process of forging three-dimensional hollow articles.

SUMMARY OF THE INVENTION

Accordingly, using liquid mercury as a freezing medium can increase cost of production, and can induce quite much trouble in management of operation, and this is the motive of study and development of the present invention. The inventor of the present invention invented the cold forging forming method for forming a three-dimensional hollow article without rough edges based on his specific experience of years in metal processing.

The main object of the present invention is to provide a cold forging method for forming a three-dimensional hollow article without rough edges, wherein, an alloy of low melting point is used as a plastic filler with plasticity, thereby an object of changing or recovery for reusing the filler can be achieved, and cost of forming can be reduced.

To achieve the above stated object, in the present invention, an alloy of low melting point is used as a filler with plasticity in the space between a die protecting member and the external wall of a seamless die cavity instead of mercury as used in the case of the above mentioned prior art. When the alloy of low melting point is in a melting state, it is characterized in the capability of being poured, discharged and recollected but can have good stiffness after being solidified, thereby, a stiff wall of the seamless die cavity can be formed, hence the alloy of low melting point in a solidified state can support the die cavity against forging pressure. The shaped work piece in the die cavity can be released when the solidified alloy is heated to melt, and an inner die for a different die cavity can be substituted for the old one, and an effect of recovery for reusing the filler can be achieved, and cost of forming can be reduced. Moreover, when the alloy of low melting point is in a melting state, stiffness after solidification of the plastic filler is increased by adding and mixing with the material of natural sand, iron sand or steel beads etc. in pursuance of the compression resistance of the forging die required, to suit blanks of higher hardness in forging.

The present invention will be apparent in its object and features after reading the detailed description of the preferred embodiment thereof in reference to the accompanying drawings.

DETAILED DESCRIPTION OF THE PREFERRED EMBODIMENT

Figure 1:
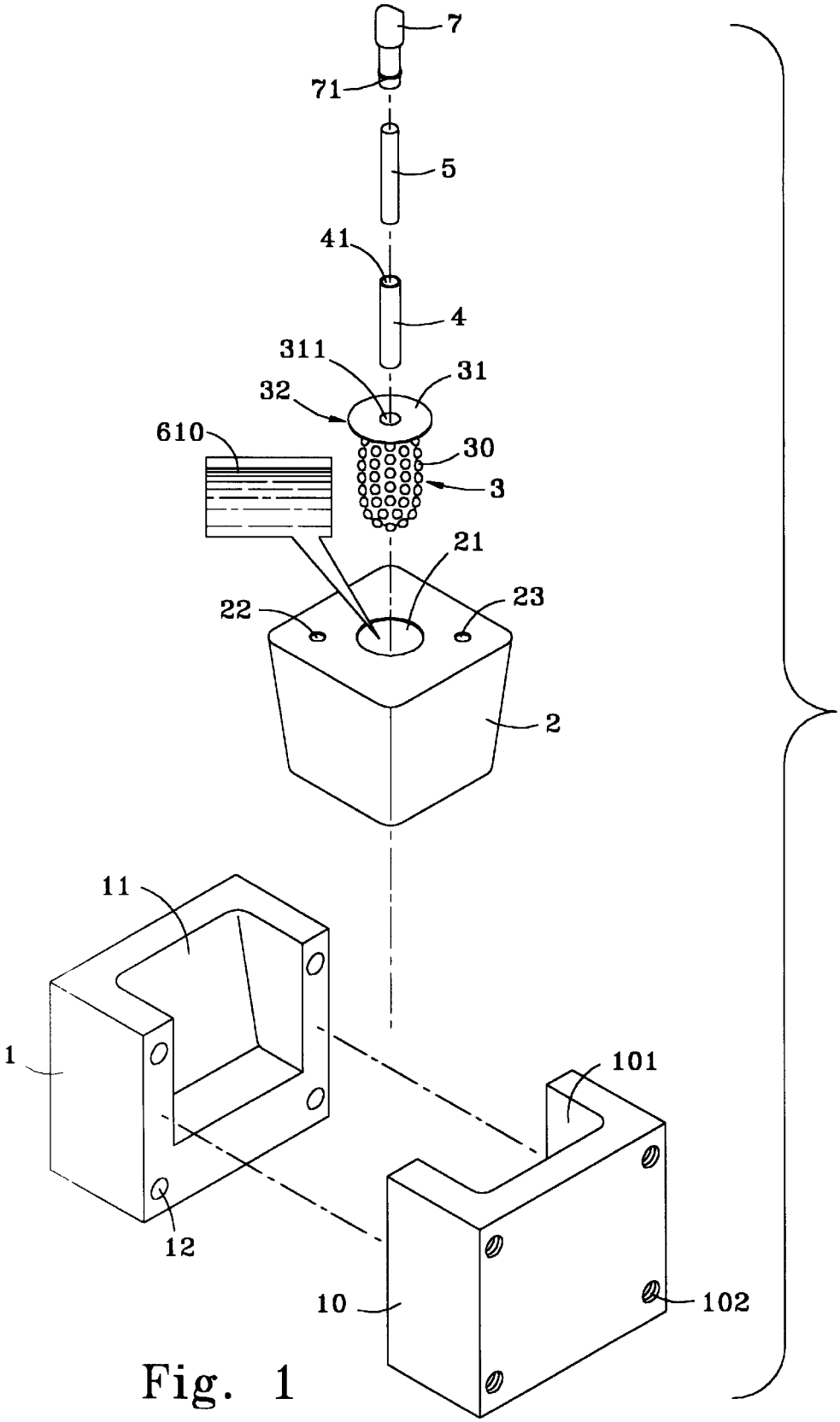
FIG. 1 is an analytical perspective view of the present invention.

As shown in FIG. 1, the cold forging forming method for forming a three-dimensional hollow article without rough edges of the present invention uses an alloy 61 of low melting point instead of mercury as a filler with plasticity, and is comprised of a pair of half dies 1 and 10, a die protecting member 2, an inner die 3, a metallic blank 4, a polyurethane strip 5 and a forging press 7 capable of generating normal forging action.

Wherein, the alloy 61 of low melting point can be chosen from five kinds of mixtures A, B, C, D and E made according to grade of fit of the components in the table 1 below:

TABLE 1

| Alloys | Melting temperature ° C. | Melting temperature ° F. | Percentage of components of mixtures Bi | Pb | Sn | Cd | others |
|---|---|---|---|---|---|---|---|
| A | 47 | 117 | 44.70 | 22.61 | 8.30 | 5.30 | 19.10 (In) |
| B | 58 | 136 | 49.00 | 18.00 | 12.00 | — | 21.00 (In) |
| C | 70 | 158 | 50.00 | 26.70 | 13.30 | 10.00 | — |
| D | 91.5 | 197 | 51.61 | 40.20 | 8.20 | — | — |
| E | 95 | 203 | 52.50 | 32.00 | 15.50 | — | — |

Data obtained from: ASM International, Metals of handbook, U.S.A. 1990

It can be seen from Table 1, alloys of low melting points made from mixing of elements such as bismuth (Bi), lead (Pb), tin (Sn), cadmium (Cd) and indium (In) can have melting points from 47° C. as is the case of alloy A in table 1 to 95° C. as is the case of alloy E in table 1, this means that these alloys of low melting points can be easily restored to their solidification state under normal temperatures. An alloy 61 of low melting point which is lower than that of the inner die 3 is selected as a plastic filler for the present invention.

The alloy A with a low melting point 47° C. in table 1 is taken as an example, it is in a stiff solidified state when it is in a normal temperature, and is in a fluid melting state when it is heated to 50° C. The alloy A is chosen as the alloy 61 of low melting point as a plastic filler for the present invention (referring to FIG. 1), it is preferred by the following facts:

The pair of half dies 1 and 10 (referring to FIG. 1) are made of conventional steel die material, in which two half die cavities 11 and 101 capable of receiving the die protecting member 2 are provided. The half dies 1 and 10 are provided on the joint sides thereof respectively with screw holes 12 and 102 for mounting the half dies or guiding, the half dies 1 and 10 can hold the die protecting member 2 when they are closed together, and can release the die protecting member 2 when they are opened.

The die protecting member 2 is vacuum injection molded from PET or PVC (referring to FIG. 1), and is in the shape of a hollow rectangular hood, an inner die insertion hole 21 is provided on the top thereof, and it is provided on one side of the inner die insertion hole 21 with an injection hole 22 for pouring in the molten alloy 610 of low melting temperature, and on the other side with a discharge hole 23 for discharging the molten alloy 610 of low melting point.

The inner die 3 is similarly made by molding from PET or PVC (referring to FIG. 1), it is vacuum injection molded to form a seamless plastic shell in pursuance of the three dimensional shape desired for the work piece to be forged. The top of the inner die 3 is processed to form a stop portion 31 with a central through hole 311 (referring to FIG. 2). The central through hole 311 communicates with a seamless die cavity 33 in the body 30 of the inner die 3, a neck 32 is formed between the stop portion 31 and the body 30. The wall shape of the seamless die cavity 33 is coincident with that of the external wall of the body 30, here we can see the shape of grapes as disclosed in the above mentioned prior art indicating an artistic shape of the three dimensional body 30 of the inner die 3 in the embodiment (referring to FIG. 1).

The blank 4 is a thin metallic pipe (referring to FIG. 1), and is provided with a central hole 41. The blank 4 can be chosen to have the shape of a cup or a pipe as desired.

The polyurethane strip 5 is in the form just like that of the hole 41 of the blank 4 (referring to FIG. 1), but is longer than the hole 41; so that it can be extended into the neck 32 of the inner die 3 after it is inserted in the hole 41.

Figure 2:
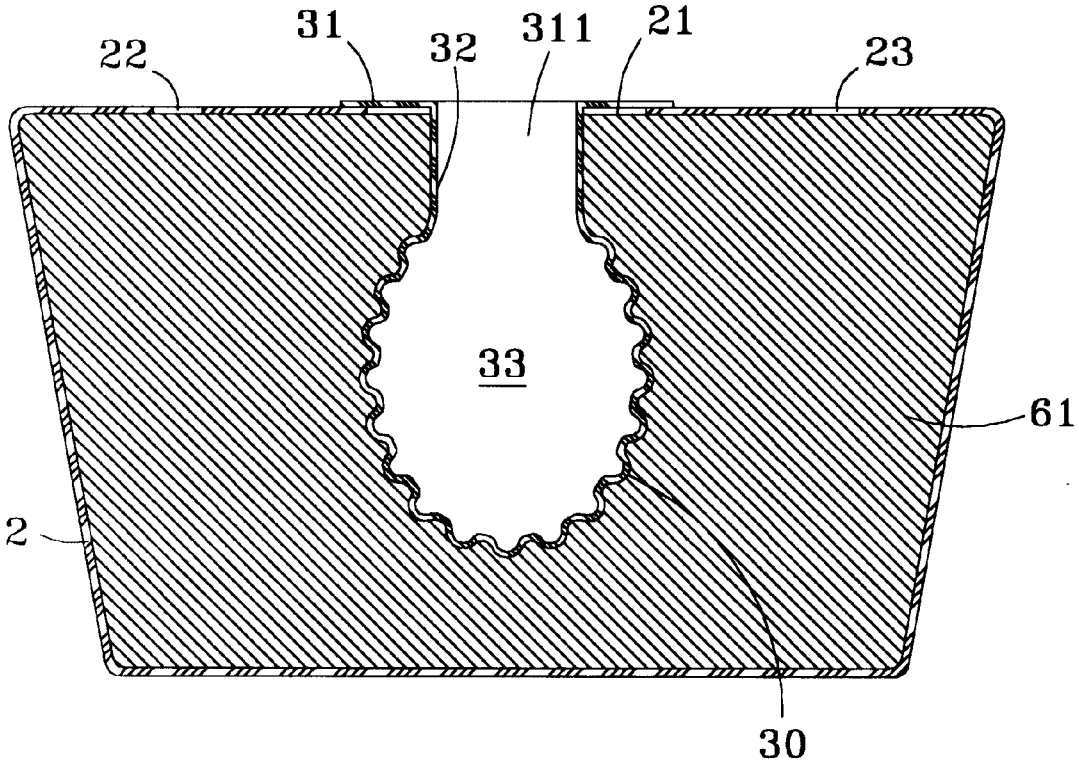
FIG. 2 is a sectional view showing the alloy of low melting point in a die protecting member of the present invention is solidified.

When in practicing the forging process, the body 30 of the inner die 3 is slipped in the inner die insertion hole 21 of the die protecting member 2 (referring to FIG. 1) to hang the stop portion 31 on the top of the inner die insertion hole 21, the inner die 3 is thereby hung in the half dies 1 and 10 (referring to FIG. 2). Then the alloy 61 of low melting point as a plastic filler is heated to 50° C. to have the molten alloy 610 of low melting point poured into the die protecting member 2 from the injection hole 22 to fully fill all the three dimensional gaps on the external wall of the body 30 of the inner die 3 till the neck 32 of the inner die 3. Thereafter, the die protecting member 2 is set in a circumstance with a normal temperature, to allow the molten alloy 610 of low melting point enveloping the inner die 3 to be gradually solidified into the stiff consolidated alloy 61 of low melting point. At this time, all three dimensional gaps on the external wall of the body 30 of the inner die 3 are fully filled with the solid alloy 61 of low melting point, and the stiff wall of the seamless die cavity 33 is formed. Moreover, suitable amount of supporting material such as iron sand or steel beads can be mixed into the molten alloy 610 of low melting point before it is solidified, in order to be the medium to increase compression resistance of the latter, and to forge blanks made of material with higher strength. These belong to the scope of the abovementioned prior art, and are not to be described further more.

Figure 3:
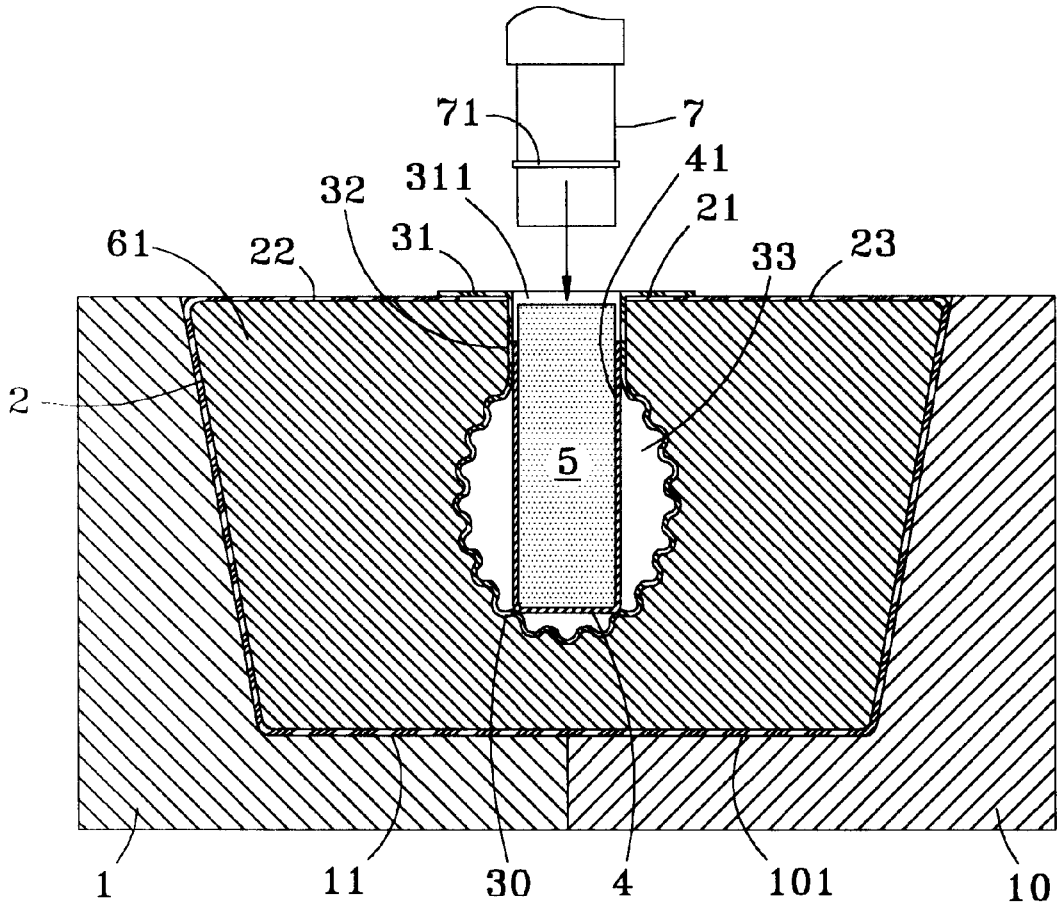
FIG. 3 is a sectional view showing the situation of a blank to be forged and a polyurethane strip placed in the seamless die cavity of the present invention.
Figure 4:
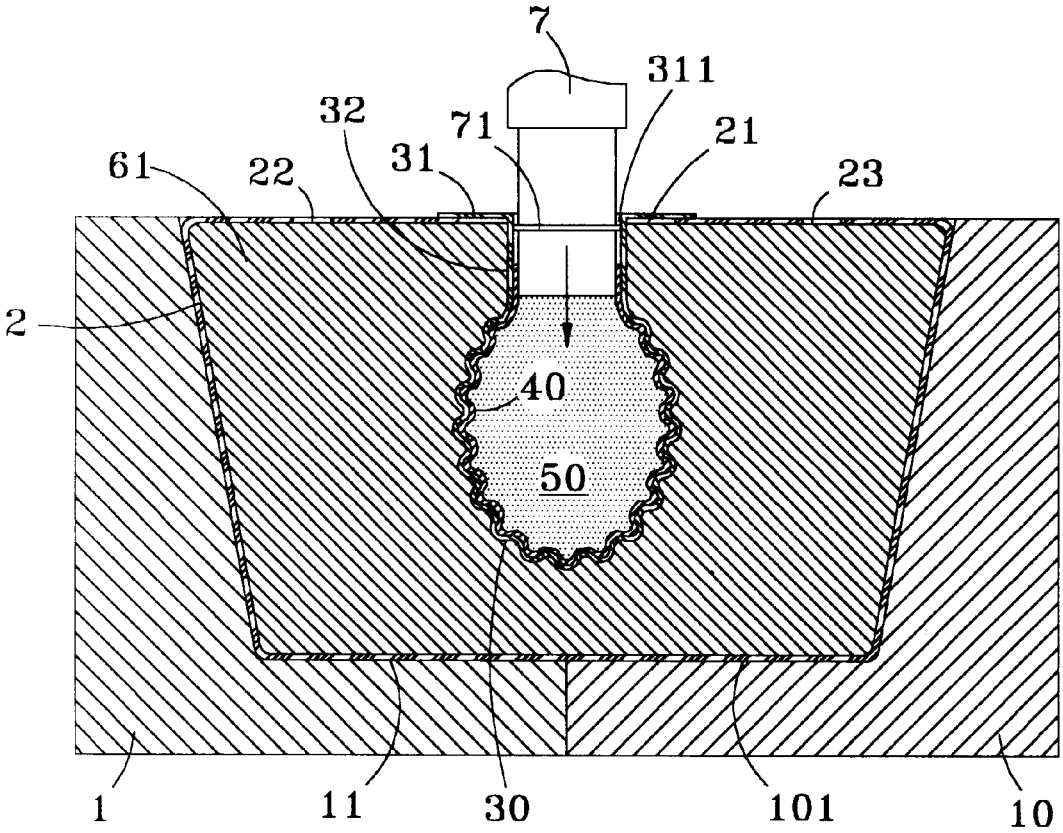
FIG. 4 is a sectional view showing the situation of the blank expanding by swaging by a forging press in the present invention.

The hole 41 of the blank 4 is inserted therein with the polyurethane strip 5, the head end of the polyurethane strip 5 is placed well in the neck 32 of the inner die 3, and the die protecting member 2 containing the inner die 3 and the solidified alloy 61 of low melting point is placed in the two half die cavities 11 and 101 of the half dies 1 and 10 having been closed to each other (referring to FIG. 3). Then the blank 4 to be forged having been inserted with the polyurethane strip 5 is placed in the seamless die cavity 33 of the inner die 3, the forging press 7 is aligned with the inner die insertion hole 21 and exerts normal forging pressure on the head end of the polyurethane strip 5. Thereby, the peripheral wall of the blank 4 is subjected to a uniform swaging action from inside outwardly by the polyurethane strip 5 to made the inner and external walls of the blank 4 a contour coincident with that of the seamless die cavity 33 (as shown in FIG. 4), and a seamless three-dimensional hollow article 40 without rough edges is integrally formed.

Figure 5:
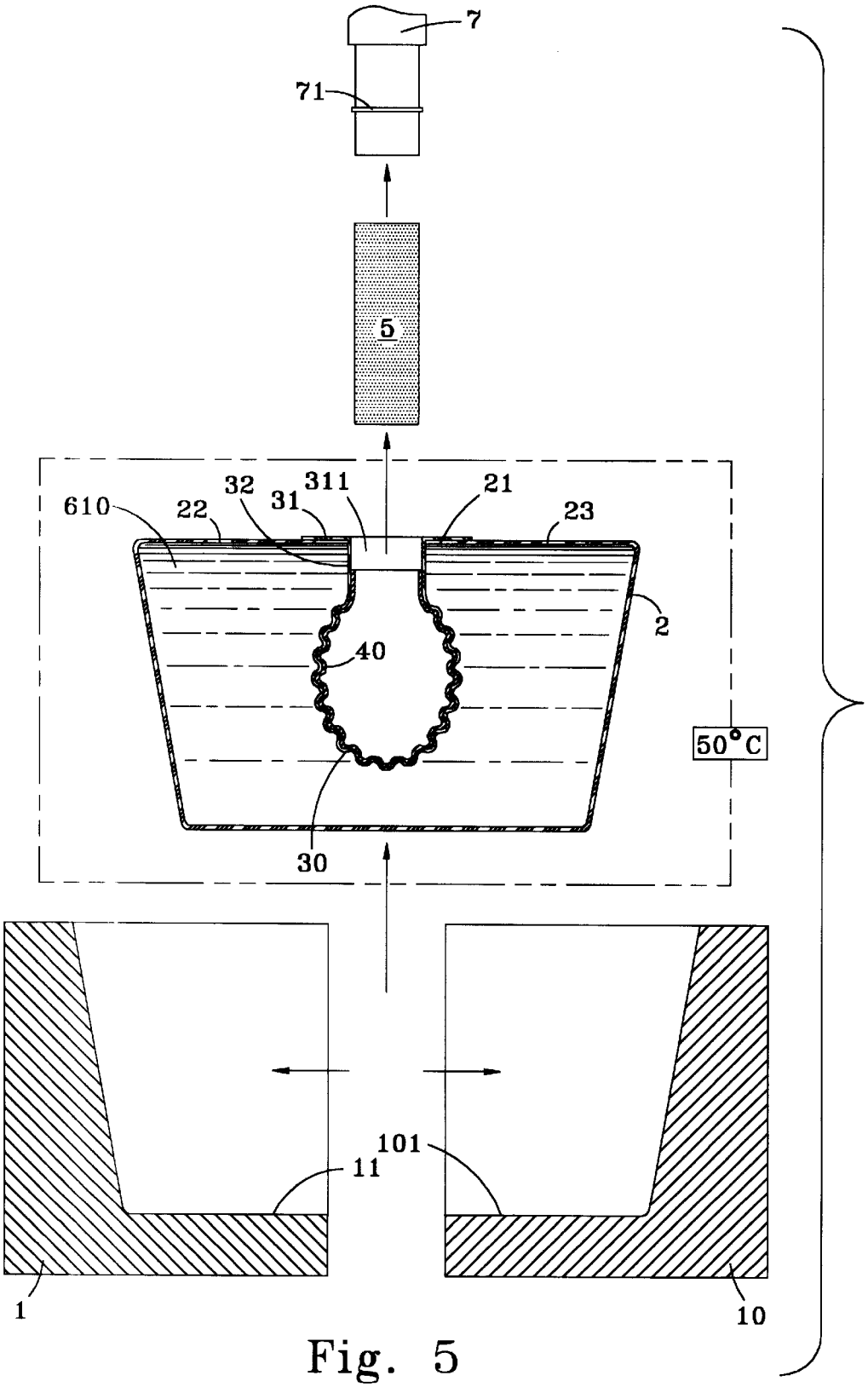
FIG. 5 is a schematic sectional view showing releasing half dies and retracting the forging press of the present invention.
Figure 6:
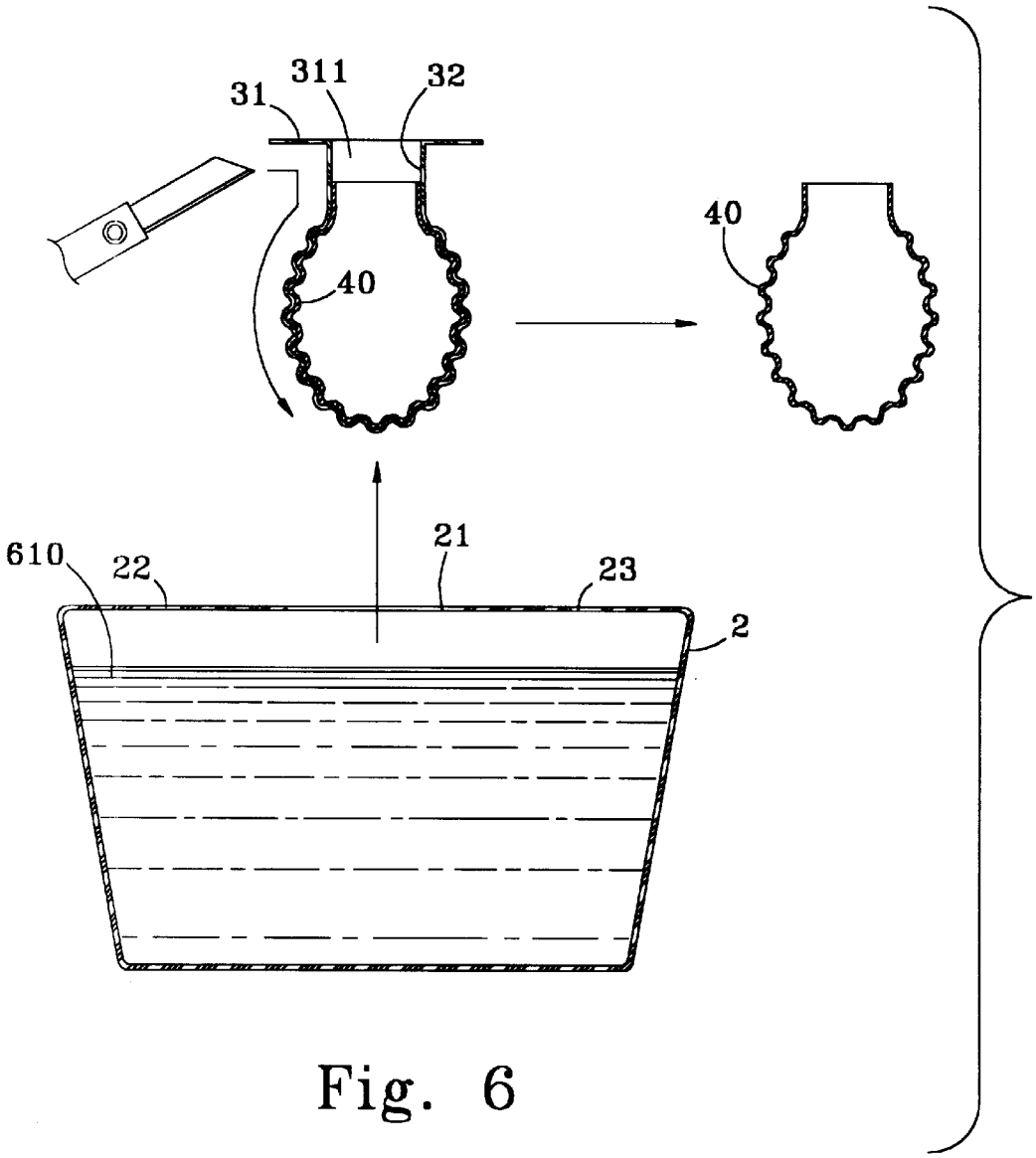
FIG. 6 is a schematic view showing the shaped work piece and a plastic shell of the inner die of the present invention.
Figure 7:
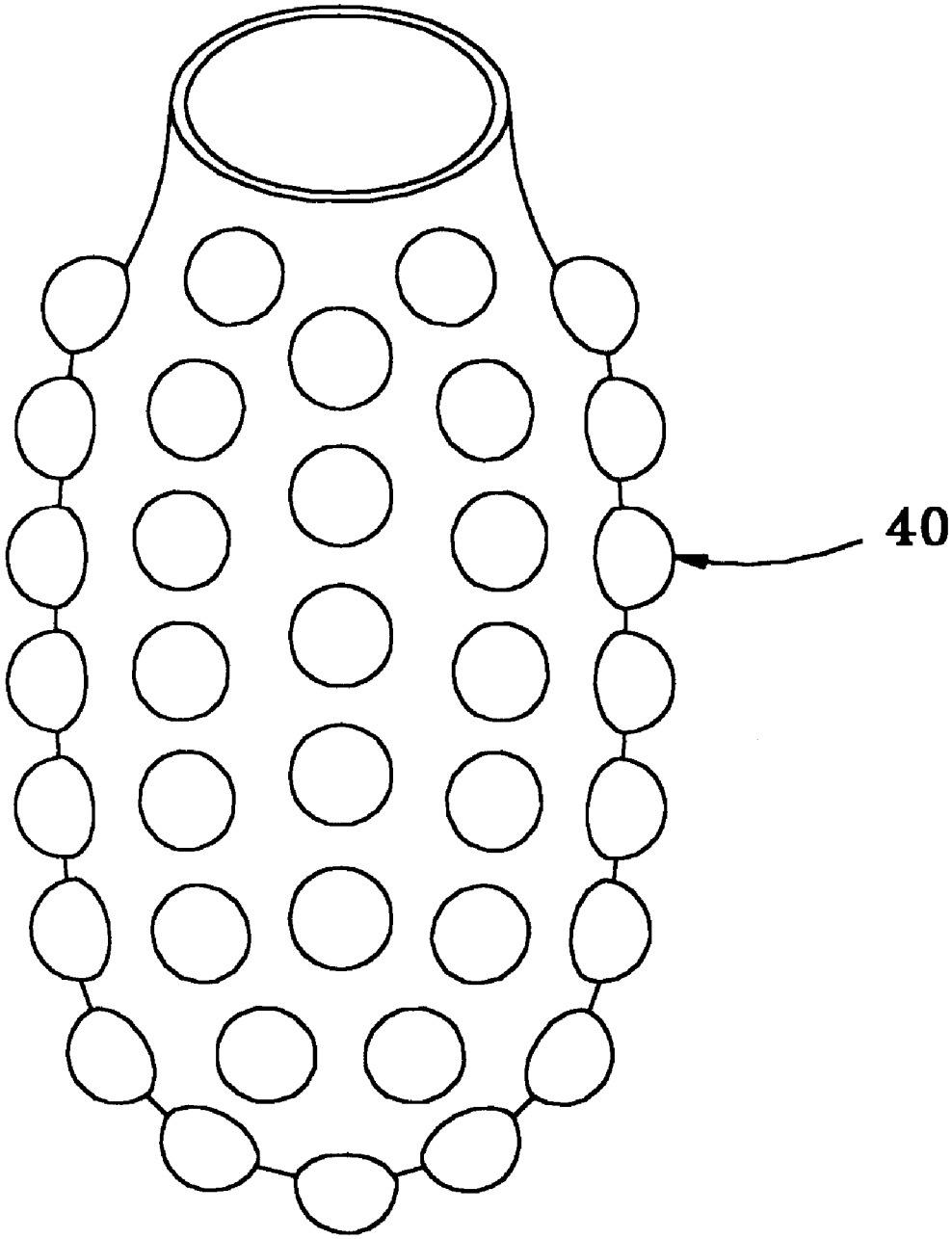
FIG. 7 is a perspective view of the shaped work piece made by the present invention.

After swaging by pressing, the forging press 7 and the half dies 1 and 10 are removed (referring to FIG. 5), at this time, the polyurethane strip 5 under extrusion and expansion state automatically restores to its original state by its flexibility. The polyurethane strip 5 can be easily taken out of the central chamber of the shaped hollow article 40. Thereafter, the die protecting member 2 is suitably heated to 50° C. to render the solidified alloy 61 of a low melting point lower than those of the die protecting member 2 and the inner die 3 to become the flowable molten alloy 610 of low melting point in favor of releasing the inner die 3 hung in the die protecting member 2. Thereby, the inner die 3 and the shaped hollow article 40 contained therein can be taken out quickly (referring to FIG. 6), and then the plastic shell of the inner die 3 is cut and removed with a knife 8 to take the shaped hollow article 40 out easily, and the shaped hollow article 40 with the shape coincident with that of the seamless die cavity 33 appears its delicate three dimensional shape without rough edges (referring to FIG. 7).

It shall be emphasized that, the alloy 61 of low melting point of the present invention instead of mercury as a filler with plasticity cost lower than mercury, it can become the molten alloy 610 of low melting point only with slight heating; when the molten alloy 610 is poured into the die protecting member 2, it is gradually consolidated under the normal temperature to become the alloy 61 of low melting point in solid state (referring to FIG. 2) to form a stiff wall in coincidence with the shape of the seamless die cavity 33. Therefore, the expensive equipment for fast freezing as required by the above mentioned prior art can be saved, and cost of production can be lowered. Besides, the alloy 61 of low melting point is in a solid state under the normal temperature, it is convenient for management of operation without worry of environmental pollution. And the alloy 61 of low melting point does not tend to attack skin of a human body, therefore, latent public damage of pollution in the processing of forming can be eliminated, cost of production can thus be lowered and safety of forming can be increased.

In conclusion, the three-dimensional hollow article without rough edges made by the cold forging forming method of the present invention is not limited to the shape of the embodiment of grapes. The alloy of low melting point instead of mercury as a filler with plasticity can be poured, discharged and recollected at normal temperatures but can have good stiffness after being solidified, thereby the solidified alloy of low melting point can support the die cavity against forging pressure. The shaped work piece in the die cavity can be released when the solidified alloy is heated to melt, and an inner die for a different die cavity can be substituted for the old one, and an effect of recovery for reusing the filler can be achieved, and cost of forming can thus be reduced.

Having thus described my invention, what I claim as new and desire to be secured by letters patent of the united states is:

1. A cold forging forming method for forming a three-dimensional hollow article comprising the following steps:

a) placing an inner die into a die protecting member through an inner die insertion hole, b) positioning said die protecting member in a pair of half dies, c) heating an alloy with a low melting point to a molten state, d) pouring said alloy into said die protecting member containing therein said inner die, e) allowing said alloy to solidify to a solid state, so that said molten alloy fills all gaps on an external wall of a body of said inner die, thereby forming a seamless die cavity, f) inserting a metallic blank containing a polyurethane strip into said seamless die cavity, and g) forging said metallic blank into a shaped article with a forging press.

* * * * *